US008225829B2

(12) United States Patent
Melamed

(10) Patent No.: US 8,225,829 B2
(45) Date of Patent: Jul. 24, 2012

(54) TRANSFERABLE PURSE ORGANIZER

(75) Inventor: Hardeep Melamed, Atlanta, GA (US)

(73) Assignee: PurseN, LLC, Atlanta, GA (US)

( * ) Notice: Subject to any disclaimer, the term of this patent is extended or adjusted under 35 U.S.C. 154(b) by 731 days.

(21) Appl. No.: 12/060,071

(22) Filed: Mar. 31, 2008

(65) Prior Publication Data

US 2008/0237068 A1 Oct. 2, 2008

Related U.S. Application Data

(60) Provisional application No. 60/908,892, filed on Mar. 29, 2007.

(51) Int. Cl.
*A45C 1/02* (2006.01)
*A45C 3/06* (2006.01)

(52) U.S. Cl. ..... 150/113; 383/2; 190/103; 190/903

(58) Field of Classification Search ..... 190/902, 190/903, 103, 105; 383/2, 67; 150/113, 150/117

See application file for complete search history.

(56) References Cited

U.S. PATENT DOCUMENTS 227,812 A * 5/1880 Vehring ..... 411/120
924,172 A * 6/1909 Merzbach ..... 150/100
2,018,809 A * 10/1935 Rodgers ..... 190/103
2,078,624 A * 4/1937 Wolff ..... 383/2
2,079,401 A * 5/1937 Eisenberg et al. ..... 150/117
2,675,042 A * 4/1954 Herrera ..... 150/112
2,691,401 A * 10/1954 Kontoff et al. ..... 206/316.1
3,120,252 A * 2/1964 Lifton ..... 190/18 R
3,443,671 A * 5/1969 Dyke ..... 190/103
3,587,795 A * 6/1971 Berry ..... 190/109
3,963,102 A * 6/1976 Carp ..... 190/108
4,078,595 A * 3/1978 Mittelmann ..... 150/112
4,773,515 A * 9/1988 Kotkins, Jr. ..... 190/103
4,811,769 A * 3/1989 Phares ..... 150/113
5,265,719 A * 11/1993 Wand ..... 190/109
5,324,115 A * 6/1994 Weinreb ..... 383/2
6,053,382 A * 4/2000 Wyant ..... 224/153
D460,622 S * 7/2002 Wong ..... D3/318
6,561,240 B2 5/2003 Ma
6,568,852 B1 * 5/2003 Godshaw et al. ..... 383/2
D495,486 S * 9/2004 Cassegrain ..... D3/233
7,293,635 B2 11/2007 Repke et al.

(Continued)

OTHER PUBLICATIONS http://www.chameleoninserts.com, downloaded and printed Mar. 31, 2008.

(Continued)

*Primary Examiner* — Tri Mai
(74) *Attorney, Agent, or Firm* — Robert M. Downey, P.A.

(57) ABSTRACT

Transferable organizers provide stabilization and ease of location for objects carried in handbags and other bags. The organizers may be independently usable and freestanding, and may be inserts inside an existing bag. At least some walls of the organizer are substantially rigid to protect the contents, make the organizer freestanding, or to conform to the dimensions of the existing bag. At least one wall of each organizer may be expandable by means of an expansion panel that can be stowed when expansion is not needed using a fastener, such as a zipper, snap, or magnetic connection. Expansion panels enable adjustment of the width, length, or height of the organizer. A eyeglass case includes an inwardly extending lip that curls over the lens of the glasses and is adjacent a rigid front section. A shoe organizer includes a cushion flap and a stabilizing flap that protects and positions the shoes.

5 Claims, 9 Drawing Sheets

U.S. PATENT DOCUMENTS

2005/0263226 A1 12/2005 Smithers
2009/0032348 A1* 2/2009 Wang ..... 190/103

OTHER PUBLICATIONS http://www.pursebriteorganizer.com, downloaded and printed Mar. 9, 2007.

http://www.purseket.com, downloaded and printed Mar. 9, 2007.

Purse Organizer Insert—www.chameleoninserts.com, printed Mar. 31, 2008.

* cited by examiner

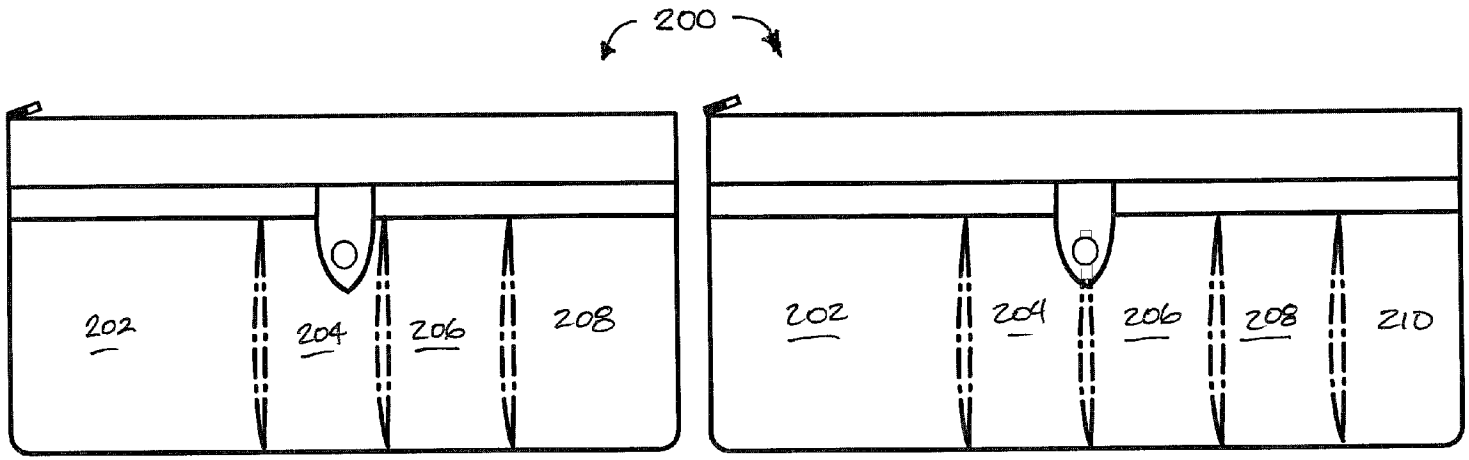
FIG. 10
FIG. 8
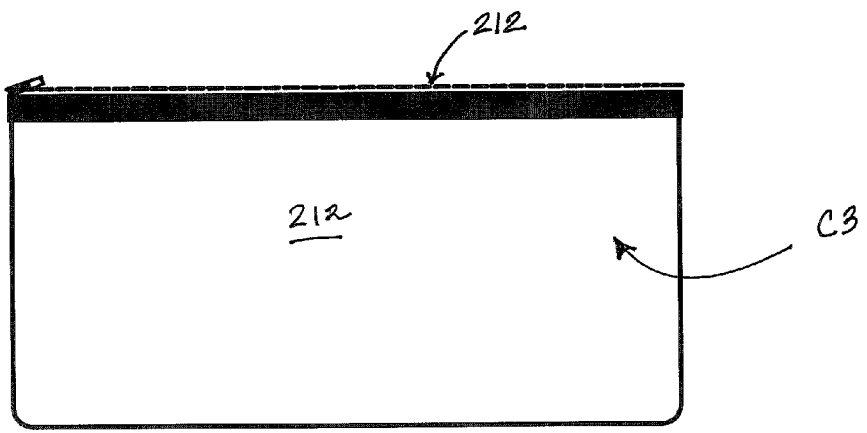
FIG. 9

TRANSFERABLE PURSE ORGANIZER

CROSS REFERENCE TO RELATED APPLICATIONS

This application claims priority to U.S. Provisional Application No. 60/908,892, filed Mar. 29, 2007, the entirety of which is herein incorporated by reference.

TECHNICAL FIELD

The disclosure involves luggage and handbags, and more specifically, a transferable organizer for purses, handbags, tote bags, and the like.

BACKGROUND

The various embodiments of the present disclosure overcome the shortcomings of the prior art by providing a transferable insert for organizing the interior of a bag, such as a handbag, make-up bag, or shoe bag. The transferable insert, hereinafter referred to as an organizer insert, stabilizes the contents of the bag, while positioning the contents of the bag for ease of location and removal. The organizer bag includes various means for positioning, such as pouches, pockets, and compartments, is transferable from one bag to another, is freestanding when outside of a bag, and is adjustable to conform to bags of various sizes and shapes.

In accordance with a first embodiment, the organizer insert is a handbag organizer that includes a pair of side walls, a bottom wall, and a pair of end walls that are substantially continuously interconnected so as to define an interior compartment. The organizer insert includes pouches, pockets, compartments, slots, and the like as means for positioning a number of objects enclosed by the bag. The means for positioning are generally distributed along any of the side walls, bottom walls, and end walls such that the position of each of the objects is substantially and reversibly fixed with respect to the opening of the bag. In other words, the person carrying the handbag can easily locate objects, particularly because the means for positioning are often tailored to enclose certain items. For example, the means for positioning may include lipstick pockets, key compartments, eyeglass compartments, and the like. In this fashion, the transferable insert organizes the objects enclosed by the bag.

The handbag organizer may also include a handle for lifting it out of the bag. In the exemplary embodiment, the handle includes two handle straps, each connected along the upper edge of one of the side walls, although the handle may be associated with any one or more of the side walls and end walls. In certain embodiments, or in use with certain handbags, the handle is visible through the opening of the bag.

The bottom wall is connected to at least two of the pair of side walls and the pair of end walls. The bottom wall is expandable to conform to the width of the bag by freeing a bottom expansion panel that is stowed using a bottom fastener. The bottom fastener can include any suitable device, including but not limited to, slide fasteners, pressure sensitive fasteners, and hook and loop fasteners such as VELCRO. Either or both of the pair of end walls may also be expandable to conform to the width of the bag by means of at least one end expansion panel that can be stowed or using an end fastener.

According to one aspect, at least one of the pair of side walls and the pair of end walls is substantially rigid such that the transferable insert is substantially freestanding.

Another embodiment provides a shoe organizer that can be carried within a bag or can be carried or used for storage independently of a secondary enclosure. The shoe organizer includes at least one wall interconnected to define a shoe compartment, and at least one cushion flap that divides and cushions the shoes, the cushion flap being elastically connected to the interior of the shoe compartment. When the pair of shoes is enclosed in the organizer bag, the cushion flap at least partially separates the shoes. The organizer bag also includes at least one stabilizing flap that is hingedly connected to the interior of the shoe compartment, such that when the pair of shoes is enclosed in the organizer bag, the stabilizing flap substantially fixes the position of each of the pair of shoes. In the exemplary embodiment, a pair of stabilizing flaps is wrapped over the pair of shoes that has been cushioned and divided by the cushion flap.

At least one wall of the shoe organizer is a bottom wall that is expandable to conform to the width of the shoes. The bottom wall is expandable by means of a bottom expansion panel. A bottom fastener is included for stowing the bottom expansion panel. For example, the bottom fastener may include slide fasteners, pressure sensitive fasteners, hook and loop fasteners. To facilitate independent carrying, the shoe organizer may include a carry strap.

As with the first embodiment, the shoe organizer includes at least one side wall, bottom wall, or end wall that is substantially rigid such that it is substantially freestanding.

Another embodiment provides an organizer case for enclosing a pair of eyeglasses. This eyeglass case includes a front section that is at least partially substantially rigid to protect the lens of the eyeglasses, a rear section for protecting the temples of the eyeglasses, and an open end for removing the eyeglasses. The front section includes a lip that curves inwardly into the interior compartment of the eyeglass case and beyond the lenses of the eyeglasses. A flap connects the front section to the rear section, the flap being extendable at least partially overlapping the front section, and secured by a flap fastener.

The foregoing has broadly outlined some of the aspects and features of the present disclosure, which should be construed to be merely illustrative of various potential applications of the disclosure. Other beneficial results can be obtained by applying the disclosed information in a different manner or by combining the disclosed embodiments. Accordingly, other aspects and a more comprehensive understanding of the principles may be obtained by referring to the detailed description of the exemplary embodiments taken in conjunction with the accompanying drawings, in addition to the scope of the disclosure defined by the claims.

BRIEF DESCRIPTION OF THE DRAWINGS

FIG. 8 is a front view of a second exemplary organizer insert useful as a make-up bag, according to an embodiment of the present disclosure.

FIG. 9 is a rear view of a second exemplary organizer insert.

FIG. 10 is a front view of an alternative version of the second exemplary organizer.

FIG. 15 is a top view of the shoe organizer, according to an embodiment of the present disclosure.

DETAILED DESCRIPTION

Figure 1:
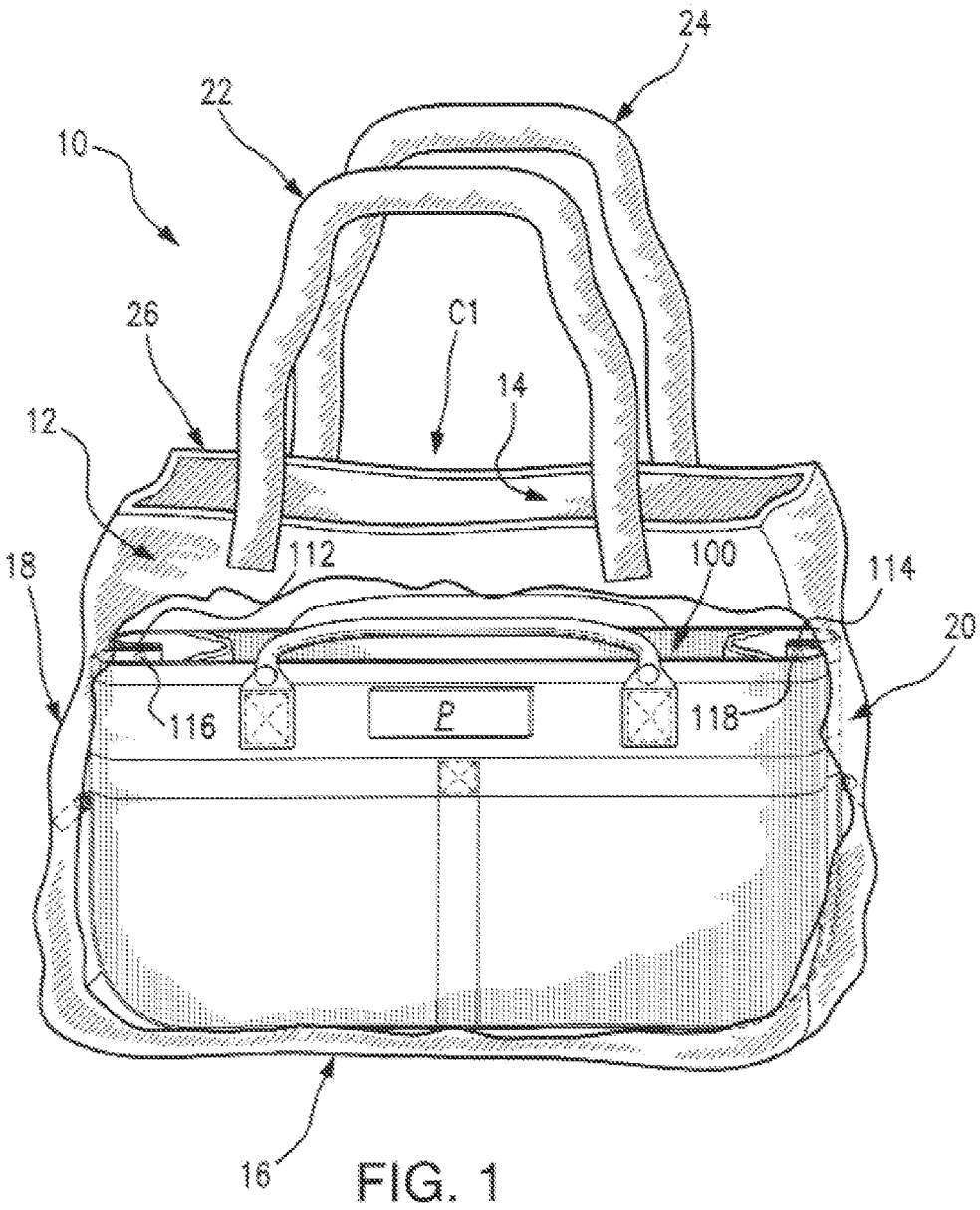
FIG. 1 is a perspective view of an exemplary handbag containing a first exemplary organizer insert, according to an embodiment of the disclosure.
Figure 2:
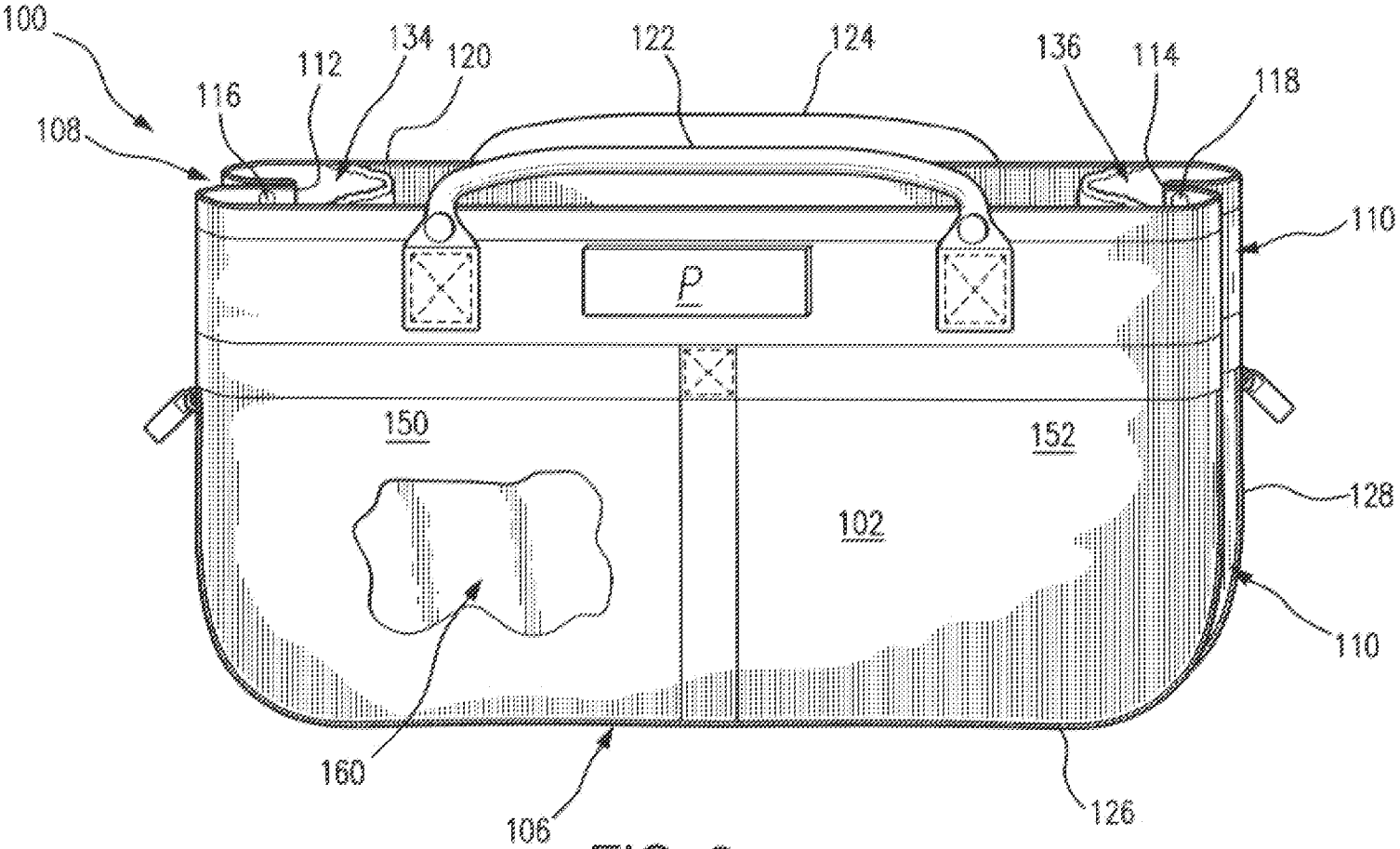
FIG. 2 is a perspective view of the exemplary organizer insert of FIG. 1.

As required, detailed embodiments of the present disclosure are disclosed herein. It will be understood that the disclosed embodiments are merely examples to illustrate aspects that may be embodied in various and alternative forms. The figures are not necessarily to scale, and some features may be exaggerated or minimized to show details of particular components. In other instances, well-known materials or methods have not been described in detail to avoid obscuring the present disclosure. Therefore, specific structural and functional details disclosed herein are not to be interpreted as limiting, but as a basis for the claims and for teaching one skilled in the art to variously employ the present disclosure.

Referring now to the drawings in which like numerals indicate like elements throughout the several views, the drawings illustrate certain of the various aspects of exemplary embodiments of an organizer for personal items carried in a bag or purse, the organizer being transferable among different bags, and adjustable to conform to the dimensions of the different bags and of differently dimensioned items enclosed by the organizer.

FIG. 1 illustrates a bag 10, which is the environment for several of the embodiments, and particularly the first embodiment, an organizer insert 100 for conveniently arranging personal items typically carried in a handbag. The bag 10 is a structured box-style handbag with well-defined walls and an open top, although the principles of the disclosure are applicable to any bag typically carried by an individual, including clutch bags, barrel bags, bucket bags, carpet bags, satchels, duffel bags, tote bags, unstructured handbags, shoulder bags, shopper bags, and the like. Furthermore, alternative bags may include a closure rather than an open top, including top zips, flaps, drawstrings, snaps, buckles, and the like.

The bag 10 includes a pair of opposed side walls 12, 14 connected to opposite side edges of a bottom wall 16, and a pair of end walls 18, 20 connected to opposite end edges of the bottom wall 16. Together, the side walls 12, 14 and the end walls 18, 20 interconnect to define an outer perimeter of the bag 10, and the bottom wall 16 encloses one end of the perimeter to define the bag compartment C1. As used herein, the term perimeter refers to the outer limits or boundary of the substantially closed plane structure defined by the side and end walls of the bag 10. A pair of handle straps 22, 24 is connected in proximity to the upper edge 26 of the bag compartment C1 to facilitate carrying the bag 10. The bag 10 may further include a frame (not shown) and may be formed from substantially rigid materials to reinforce or otherwise provide additional structural integrity.

FIGS. 2-7 illustrate the organizer insert 100 as a first embodiment of the present disclosure. The organizer insert 100 is configurable to fit inside of the bag 10 and is expandable to conform to the dimensions of a larger bag (not shown). Thus, the organizer insert 100 is particularly useful as a handbag insert. More specifically, the organizer insert 100 includes a pair of side walls 102, 104 that are intended to extend along the side walls 12, 14 of the bag 10, an expandable bottom wall 106 that is intended to rest upon the bottom wall 16 of the bag, and a pair of end walls 108, 110 that are intended to extend along the end walls 18, 20 of the bag 10. Together, the side, end, and bottom walls define an insert compartment C2 that is substantially smaller than the bag compartment C1, so that the organizer insert 100 fits inside the bag 10.

As mentioned above, the organizer insert 100 is expandable. To that end, one or both of the end walls 108, 110 includes an end expansion panel 112, 114. The end expansion panel 112, 114 is stowed when the organizer insert 100 is configured for a narrower bag, and becomes part of the perimeter of the organizer insert 100 when it is configured for a wider bag. Each end expansion panel 112, 114 is stowed using an end fastener 116, 118, which in the embodiment shown is a snap, although any suitable fastener is contemplated. The end fastener 116, 118 reversibly joins the side edges of the end expansion panel 112, 114 so as to cause the end expansion panel 112, 114 to gusset inwardly or outwardly to reduce the width of the end wall 108, 110. As one alternative, the end walls 108, 110 may blouse out somewhat in the expanded state, and may include corner straps (not shown) to tighten the end walls 108, 110 against the side walls 102, 104.

As used herein, the term fastener refers to any known or yet to be developed means for at least temporarily fixing the relative position of objects or parts, closing an opening, or for joining together two objects or parts at least initially intended to be separate. Examples of suitable fasteners include, but are not limited to, hook and loop closures, catches, hasps, clasps, latches, buckles, clips, clamps, magnetic closures, slide fasteners such as zippers and profiled linkages, reusable adhesives, and pressure sensitive closures.

Figure 6:
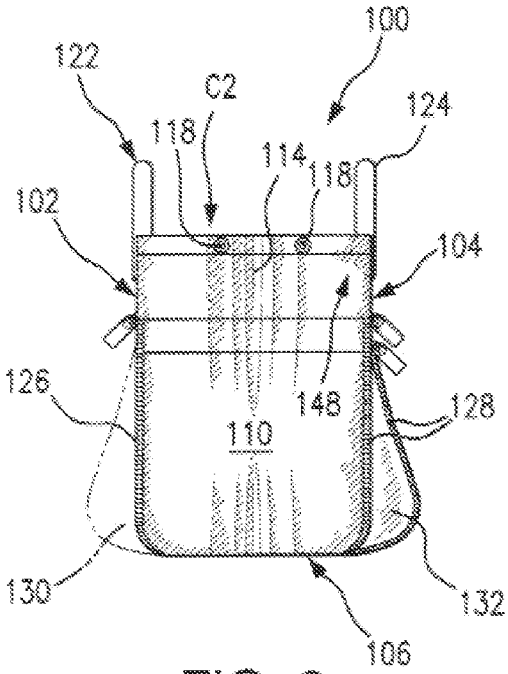
FIG. 6 is an end elevational view of the organizer insert of FIG. 1, its bottom wall having been partially expanded.
Figure 7:
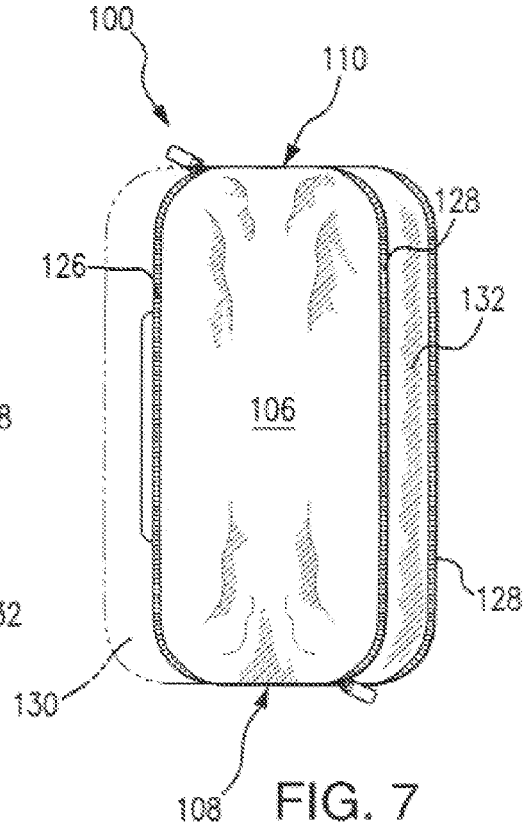
FIG. 7 is a bottom view of the first organizer insert of FIG. 1, its bottom wall having been partially expanded.

The bottom wall 106 of the organizer insert 100 is also expandable. A pair of bottom fasteners 126, 128 connected to the bottom wall 106 is usable to stow a pair of bottom expansion panels 130, 132, which are best shown in FIGS. 6 and 7, below (although the bottom expansion panel 130 is stowed by the bottom fastener 126 in both figures). The bottom fasteners 126, 128 shown are slide fasteners, such as metal or plastic zippers, which enable the user to quickly and easily stow or unstow the bottom expansion panels 130, 132 to increase the width of the bottom wall 106. However, any suitable fastener is contemplated, including but not limited to, VELCRO strips and the like. Furthermore, an expansion panel may be disposed in the middle of the end wall 106 rather than interconnecting the end wall 106 and the side walls 102, 104 as shown in the figures. It should be noted that the bottom expansion panels 130, 132 and bottom fasteners 126, 128 can concurrently expand the lower portions of the end walls 108, 110, because they extend as much as two thirds of the way up the end walls 108, 110 as well as along the entire length of the bottom wall 106.

The organizer insert 100 also includes at least one insert handle 122, 124 as means for lifting the organizer insert 100 in and out of the bag 10, shown here as a pair of straps connected along the upper edge 120 of the organizer insert 100. The insert handle 122, 124 may be visible and accessible without extending above the upper edge 26 of the bag 10, unless visibility outside the bag 10 is desired.

Adjustability of the organizer insert 100 is particularly useful to reduce the tendency of the organizer insert 100 to slide around on the bottom wall 16 of the bag 10. To further secure position of the organizer insert 100 with respect to the bag compartment C1, the organizer insert 100 may be anchored in some fashion, such as with a VELCRO strip between the respective bottom walls 16, 106.

Figure 3:
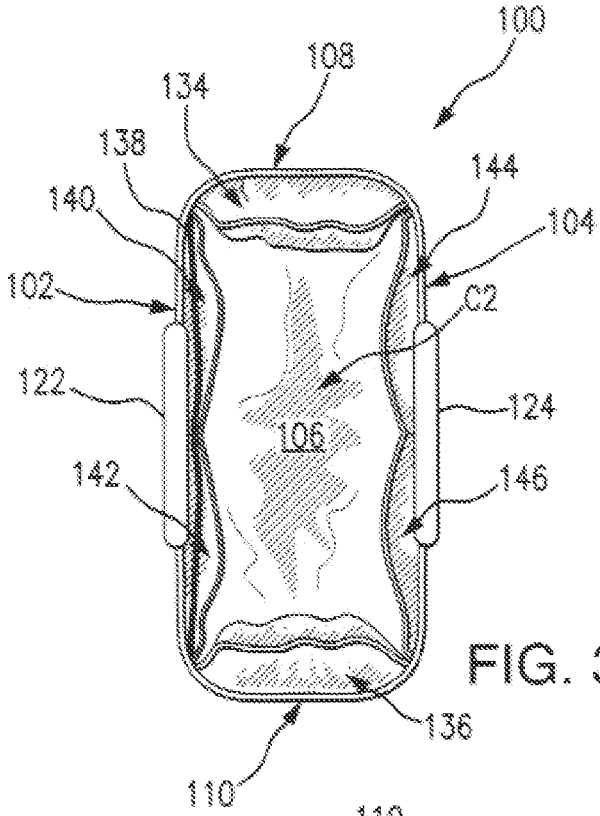
FIG. 3 is a top view of the organizer insert of FIG. 1.
Figure 4:
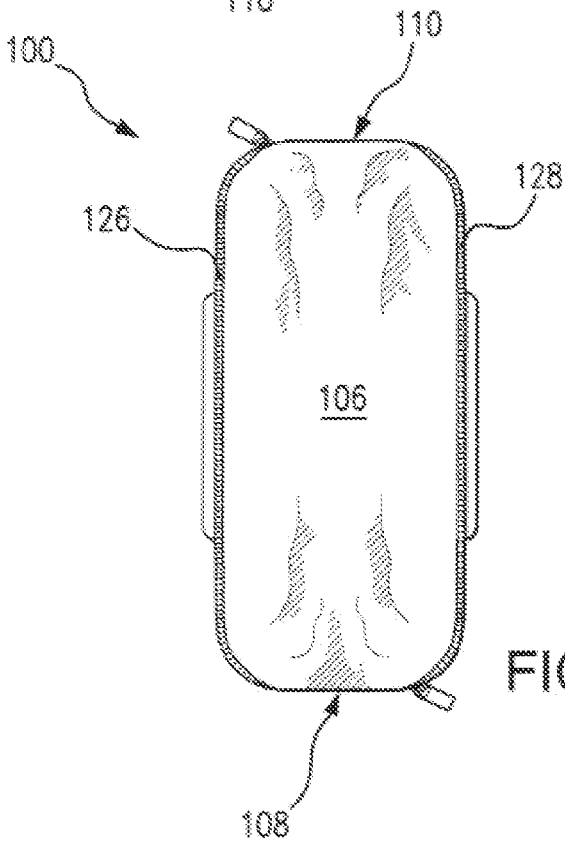
FIG. 4 is a bottom view of the organizer insert of FIG. 1.
Figure 5:
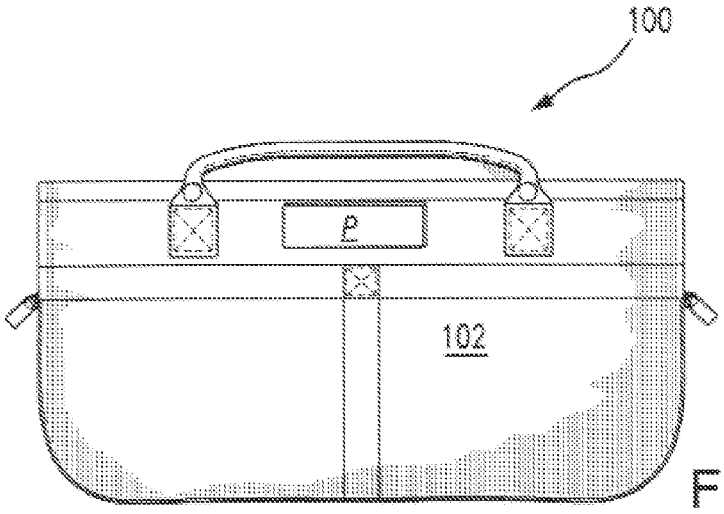
FIG. 5 is a front elevational view of the organizer insert of FIG. 1.

The organizer insert 100 includes a number of means for positioning objects that would generally be carried freely within the bag in absence of the organizer insert 100. Referring specifically now to FIG. 3, means for positioning objects include a number of interior pouches 134, 136, 138, 140, 142, 144, 146 secured inside of the insert compartment C2. Interior pouches 134, 136 are secured along the end walls 108, 110 and are particularly useful for positioning and receiving frequently used or large objects such as eyeglasses and cases therefor, beverage bottles, car keys, and the like. Interior pouch 138 is a zipper pouch that may extend entirely along the side wall 102, and is particularly useful for enclosing small objects, objects that are easily damaged, objects that are accessed less often, and objects that are more personal. A change purse (not shown) may be secured to inside of the interior pouch 138 or elsewhere. Interior pouches 140, 142 also secured along the side wall 102 and interior pouches 144, 146 secured along the side wall 104 are particularly useful for objects for which easy accessibility is desired, such as small wallets or change purses, compacts, lipstick, cell phones, chewing gum and mints, business card holders, and the like. An elongated sleeve 148 may be included to holster thin objects such as writing and makeup pens.

The organizer insert 100 may also include means for positioning objects on the exterior of the organizer insert 100. For example, the exemplary organizer insert 100 includes exterior pouches 150, 152.

The organizer insert 100 is substantially freestanding in that when removed from the bag 10, the organizer insert will substantially retain its shape when resting on its bottom wall 106. To that end, any or all of the side walls 102, 104, bottom wall 106, and end walls 108, 110 may be formed of or include an additional panel 160 of a substantially rigid material, such as plastic or paperboard.

The insert compartment C2 is also a means for positioning objects. Referring now to FIGS. 8-12, objects that can be held within the insert compartment, for example, include the second exemplary organizer insert and the third exemplary organizer insert. The organizer insert of FIG. 8 is shown as a make-up bag 200. The make-up bag 200 includes several exterior pockets 202, 204, 206, 208 which may vary in size. For example, the exterior pocket 202 shown is relatively larger than the exterior pockets 204, 206, 208 and may accommodate a larger object such as a compact, while the exterior pockets 204, 206, 208 may be more suited to hold lipsticks. The make-up bag 200 may include fewer or more pockets or pouches, as demonstrated in FIG. 10, which includes an additional lipstick-sized exterior pocket 210. FIG. 9 illustrates the reverse side of the make-up bag 200, which shows a make-up compartment C3 that may extend substantially along the entire length of the make-up bag 200 and may include a rear panel 212 that is clear so as to make the contents of the make-up bag 200 visible from the outside.

Figure 11:
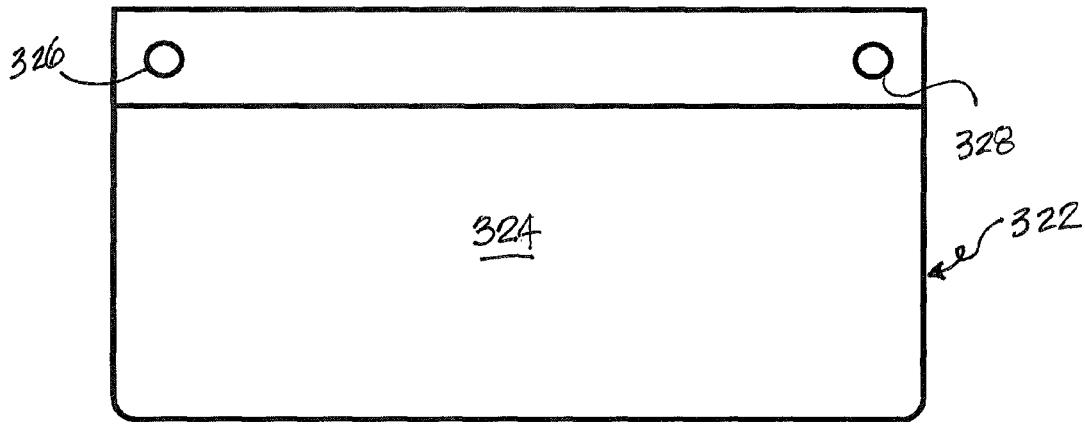
FIG. 11 is a front view of a third exemplary organizer insert useful as a make-up clutch, according the present disclosure.
Figure 12:
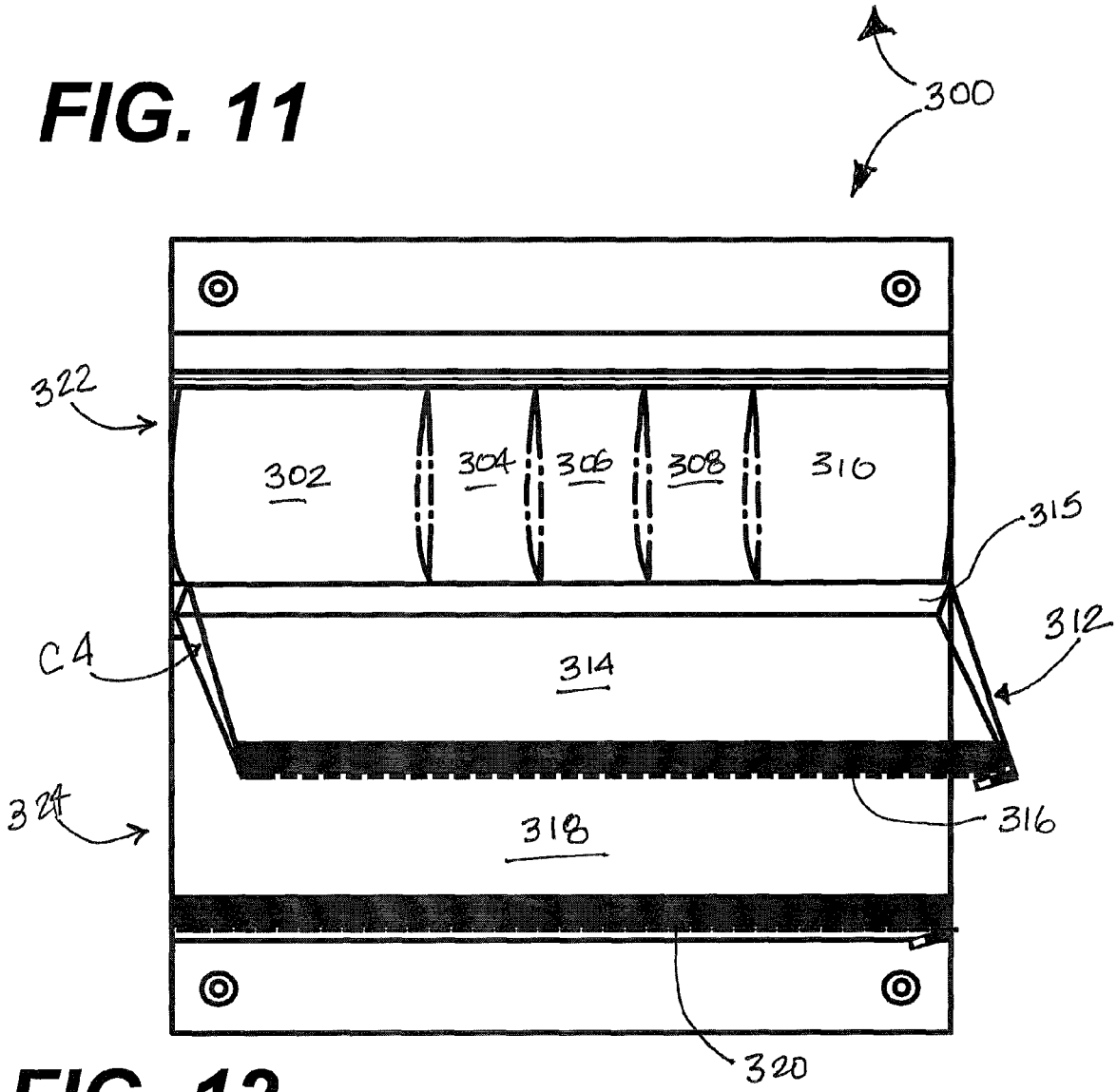
FIG. 12 is a perspective view of the organizer insert of FIG. 11, showing the interior of the third organizer insert.

FIGS. 11 and 12 illustrate the third exemplary organizer insert, which is shown as a make-up clutch 300. The make-up clutch 300 includes several interior pockets 302, 304, 306, 308, 310 which may vary in size. For example, the exterior pocket 302 shown is relatively larger than the exterior pockets 304, 306, 308, 310 and may accommodate a larger object such as a compact, while the exterior pockets 304, 306, 308, 310 may be more suited to hold lipsticks. The make-up clutch 300 includes a zippered pocket 312 with panels 314 that may be clear. The zippered pocket 312 may be removable along a connecting strip 315 that may be lined, for example with magnetic strips, VELCRO or a reusable adhesive. A zipper 316 opens and closes the zippered pocket 312. The make-up clutch 300 also includes a zippered pouch 318 that is accessed via a zipper 320. The interior pockets are disposed along the inside surface of a rear panel 322 and the zippered pouch 318 is disposed along the inside surface of a front panel 324 that are connected together along the connecting strip 315. The rear panel 322 and the front panel 324 can be brought together to enclose and at least partially conceal the contents of the make-up clutch 300. This closed condition can be secured using fasteners, such as but not limited to mechanical or magnetic snaps 326, 328.

Figure 13:
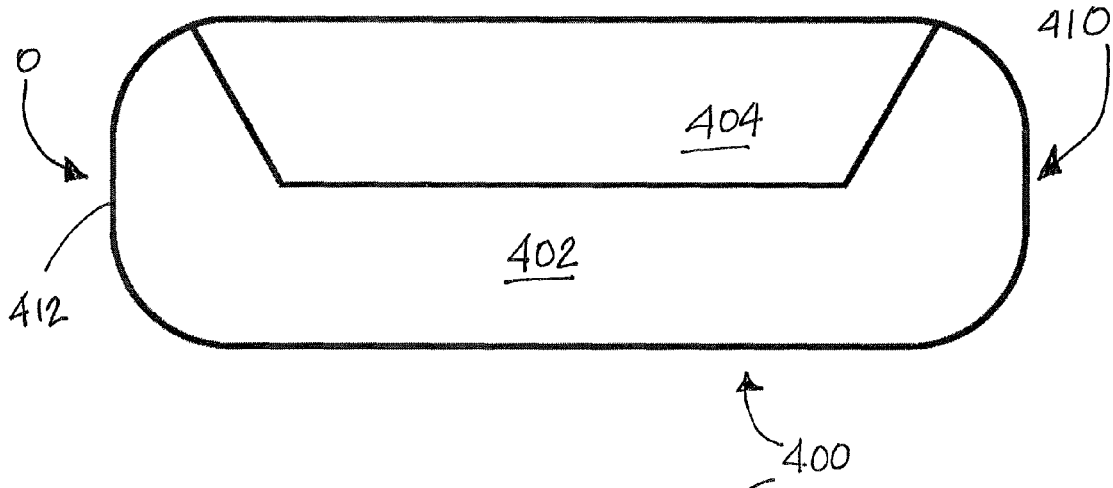
FIG. 13 is a front view of fourth exemplary organizer insert for enclosing eyeglasses, according to an embodiment of the present disclosure.
Figure 14:
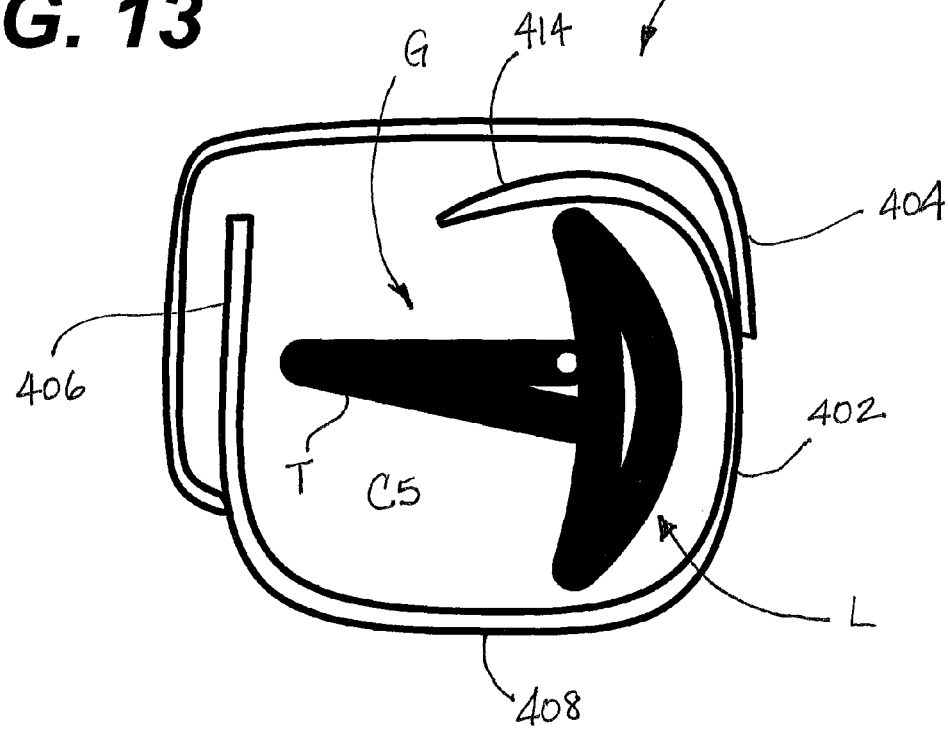
FIG. 14 is an end view of an open end of the organizer insert of FIG. 13.
Figure 15:
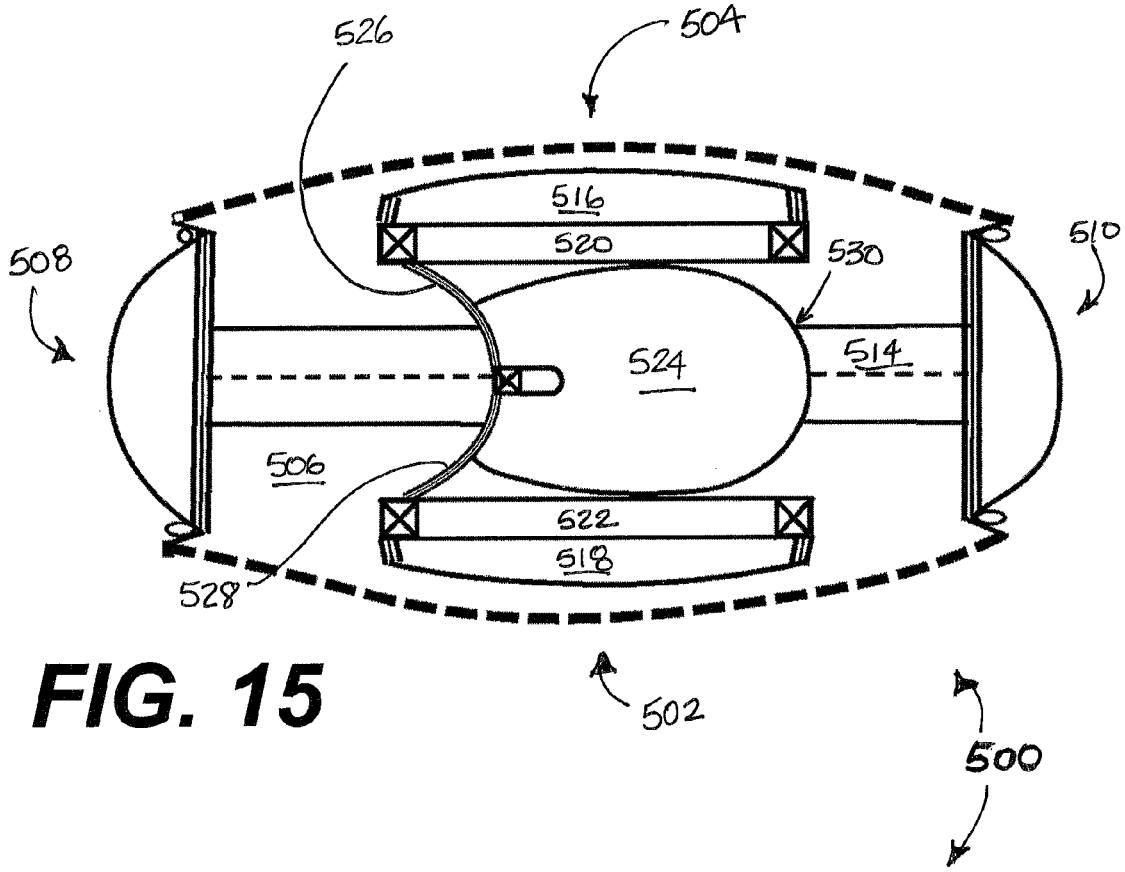
FIG. 15 is a top view of an exemplary shoe organizer, according to an embodiment of the present disclosure.

The fourth embodiment shown in FIGS. 13 and 14 demonstrates another object that can be received in the insert compartment C2, and particularly in one of the interior pouches 134, 136, namely an eyeglass case 400. The eyeglass case 400 includes a front section 402, a flap 404, a rear section 406, and a bottom section 408. One end 410 of the eyeglass case 400 may be totally or partially enclosed, although the dispensing end 412 is defines an opening O through which the eyeglasses G can be removed from the eyeglass case 400. The front section 402 includes a lip 414 that curves inwardly into the compartment C5 within the eyeglass case 400 and beyond the lenses of the eyeglasses G to protect the lenses. The front section 402 may be substantially rigid to increase the structural integrity of the eyeglass case 400, while the rear section may be substantially pliable to enable the eyeglass case 400 to accommodate eyeglasses with various frame sizes.

Figure 18:
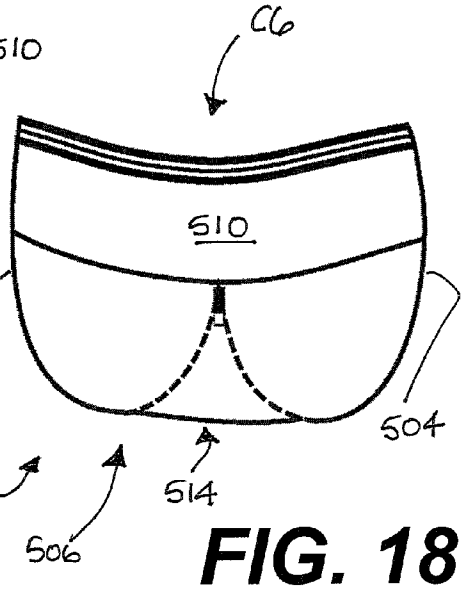
FIG. 18 is an end view of the shoe organizer of FIG. 15, its bottom wall having been expanded.
Figure 17:
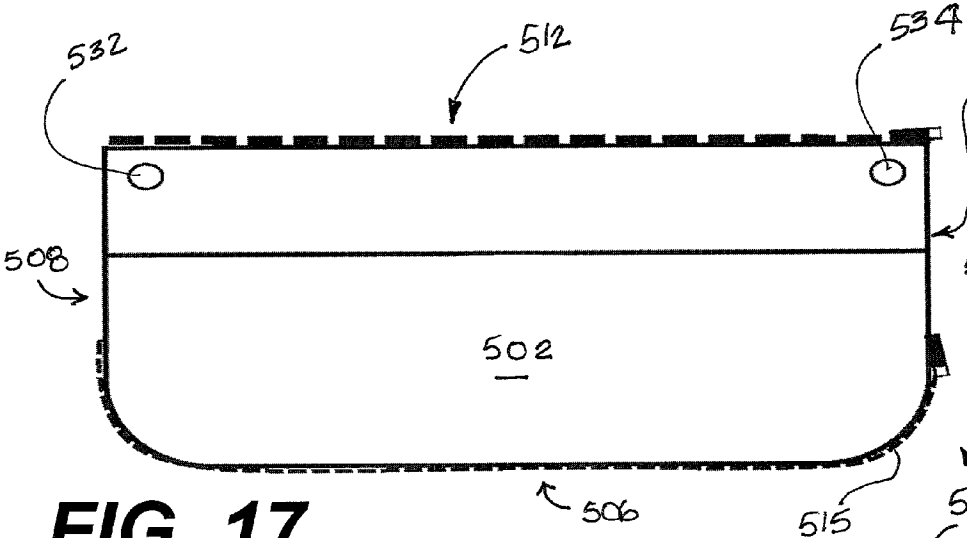
FIG. 17 is a front view of the shoe organizer of FIG. 15.
Figure 19:
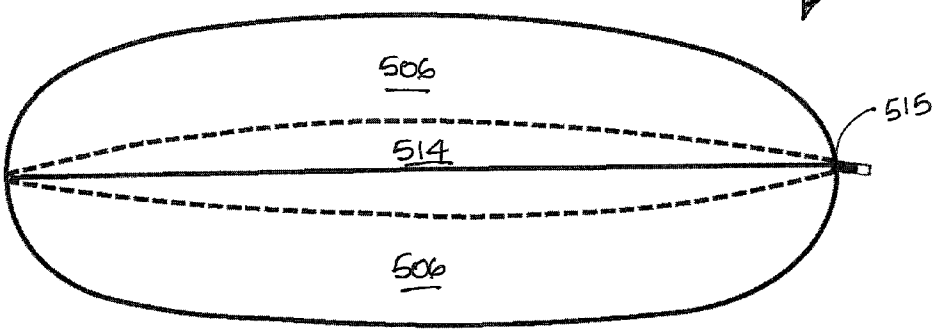
FIG. 19 is a bottom view of the shoe organizer of FIG. 15, its bottom wall having been expanded.

FIGS. 15-19 illustrate a fifth embodiment of an organizer insert, namely a shoe organizer 500. The shoe organizer 500 includes a pair of side walls 502, 504, a bottom wall 506, a pair of end walls 508, 510, and top fastener 512. In the embodiment shown, the top fastener 512 is a zipper that connects the top edges of the side walls 502, 504 together to close the shoe organizer 500. As shown in FIGS. 18 and 19, the bottom wall 506 is expandable by via a bottom expansion panel 514 that bifurcates the bottom wall 506 and extends into the storage compartment C6 when it is stowed using the bottom fastener 515, which in the exemplary embodiment, is a zipper.

Figure 16:
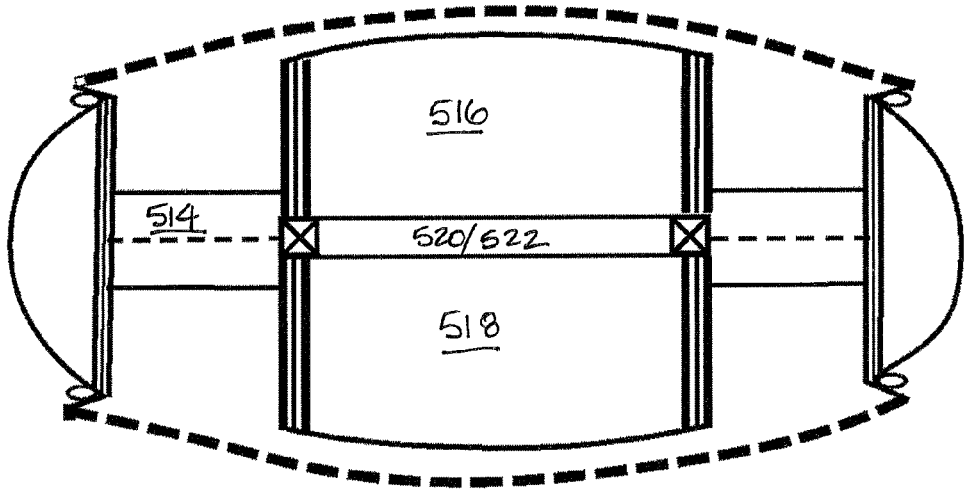
FIG. 16 is a top view of the shoe organizer of FIG. 15, with its cushioning flaps closed.

The shoe compartment C6 includes means for positioning a pair of shoes, including a pair of stabilizing flaps 516, 518 that can be interconnected using edge fasteners 520, 522 connected to the distal edges of each. The edge fasteners can matingly interconnect as closure 520/522 and may include, for example, a VELCRO strip, magnetic fasteners, zippers or snaps. A pair of shoes is enclosed, protected, and stabilized within the shoe compartment C6 as follows. The vamp portion of one of the pair of shoes, i.e., the front part of the shoe upper that covers the toes and possibly part of the foot, is inserted beneath a cushion flap 524. The exemplary cushion flap 524 is connected to the interior of the shoe compartment C6 by cushion straps 526, 528, 530 (not shown). The cushion straps 526, 528, 530 are elastic or adjustable so that the cushion flap 524 fits snugly against the vamp of the shoe (not shown) and can accommodate various sizes and styles of shoes. The second of the pair of shoes is reversed so that the cushion flap 524 is between the vamps of the shoes and the heels of the shoes are at opposite ends of the shoe compartment C6 and are extending in opposite directions. With the shoes in this mating arrangement, and with the cushion flap 524 between the vamps of the shoes, the stabilizing flaps 516, 518 are joined together as shown in FIG. 16 to extend over the pair of shoes.

As mentioned above, the shoe organizer 500 is adjustable to accommodate various sizes and styles of shoes. Adjustability is gained through the expandable bottom wall, the elastic connection between the cushion flap 524 and at least one of the walls 502, 504, 506, 508, 510, and also by tightening fasteners 532, 534 disposed near the top fastener 512 and the end walls 508, 510 that tighten and streamline the shoe organizer 500.

As mentioned, the shoe organizer 500 may be used independently for carrying shoes, such as to enable the user to change shoes during the day. The shoe organizer 500 can also be useful to catalog and store shoes, and may include a label for describing the shoes within. Alternatively, any or all of the walls of the shoe organizer can be made of clear or sheer materials to make the contents visible.

The present disclosure has been illustrated in relation to particular embodiments which are intended in all respects to be illustrative rather than restrictive. Those skilled in the art will recognize that the present disclosure is capable of many modifications and variations without departing from the scope of the disclosure. For example, as used herein, directional references such as "top", "base", "bottom", "end", "side", "inner", "outer", "upper", "middle", "lower", "front" and "rear" do not limit the respective walls of the carton to such orientation, but merely serve to distinguish these walls from one another. Any reference to hinged connection should not be construed as necessarily referring to a junction including a single hinge only; indeed, it is envisaged that hinged connection can be formed from one or more potentially disparate means for hingedly connecting materials. Any of the embodiments may be constructed of any suitable material, including satin, microfiber, leather, plastic, suede, woven fabric, and the like.

Those skilled in the art will also appreciate that the characteristics of the bags described herein are not intended to be limiting, but rather simply provide context for the environment of the disclosure. In addition, any suitable materials and closure devices may be used in addition to or instead of zippers and snaps, including magnets, non-permanent adhesives, or hook and loop fasteners such as VELCRO®, which is a trademark registered to Velcro Industries B.V. Accordingly, the scope of the present disclosure is described by the claims appended hereto and supported by the foregoing.

The invention claimed is:

1. A transferrable insert for organizing the interior of a bag having side walls and end walls to define a width and a length of the interior of the bag, said transferrable insert comprising:

a pair of side walls, a pair of end walls and a bottom wall substantially continuously interconnected so as to define an interior storage compartment, a continuous upper edge defined along a top of said pair of side walls and said pair of end walls, and said continuous upper edge surrounding a top opening of the transferrable insert that is disposed in communication with the interior storage compartment for allowing unobstructed access to the interior storage compartment, and said pair of side walls, said pair of end walls and said bottom wall being sized, structured and configured to allow the transferrable insert to be removeably received within the interior of the bag;

a first bottom expansion panel extending between said bottom wall and a first one of said pair of side walls, and a second bottom expansion panel extending between said bottom wall and a second one of said pair of side walls and each of said first and second bottom expansion panels being operatively moveable between a collapsed position and an expanded position to conform to the width of the interior of the bag;

a first bottom fastener structured and disposed for holding said first bottom expansion panel stowed in the collapsed position and being operable to release said first bottom expansion panel to the expanded position;

a second bottom fastener structured and disposed for holding said second bottom expansion panel stowed in the collapsed position and being operable to release said second bottom expansion panel to the expanded position;

each one of said pair of end walls including a separate end expansion panel operatively moveable between a gusseted position to reduce a width of the end wall, and an expanded position to increase the width of the end wall to conform to the width of the interior of the bag;

each of said end expansion panels including an end fastener structured and disposed for holding said end expansion panel in said gusseted position and for releasing said end expansion panel to said expanded position;

said pair of side walls each including a panel of a substantially rigid material for retaining a freestanding shape of the transferrable insert; and a plurality of pouches within said interior storage compartment for holding and positioning a plurality of objects therein in an organized arrangement.

2. The transferrable insert of claim 1 further comprising:

at least one handle member for lifting the transferrable insert out of the interior of the bag.

3. The transferrable insert of claim 1 further comprising:

a pair of handle members for lifting the transferrable insert out of the interior of the bag.

4. The transferrable insert of claim 3 wherein said pair of handle members includes a first handle member and a second handle member each associated with at least one of said pair of side walls and said pair of end walls.

5. A transferrable insert for organizing the interior of a bag having side walls and end walls to define a width and a length of the interior of the bag, said transferrable insert comprising:

a pair of side walls, a pair of end walls and a bottom wall substantially continuously interconnected so as to define an interior storage compartment, a continuous upper edge defined along a top of said pair of side walls and said pair of end walls, and said continuous upper edge surrounding a top opening of the transferrable insert that is disposed in communication with the interior storage compartment for allowing unobstructed access to the interior storage compartment, and said pair of side walls, said pair of end walls and said bottom wall being sized, structured and configured to allow the transferrable insert to be removeably received within the interior of the bag;

a first bottom expansion panel extending between said bottom wall and a first one of said pair of side walls, and a second bottom expansion panel extending between said bottom wall and a second one of said pair of side walls and each of said first and second bottom expansion panels being operatively moveable between a collapsed position and an expanded position to conform to the width of the interior of the bag;

a first bottom fastener structured and disposed for holding said first bottom expansion panel stowed in the collapsed position and being operable to release said first bottom expansion panel to the expanded position;

a second bottom fastener structured and disposed for holding said second bottom expansion panel stowed in the collapsed position and being operable to release said second bottom expansion panel to the expanded position;

each one of said pair of end walls including a separate end expansion panel operatively moveable between a gusseted position to reduce a width of the end wall, and an expanded position to increase the width of the end wall to conform to the width of the interior of the bag;

each of said end expansion panels including an end fastener structured and disposed for holding said end expansion panel in said gusseted position and for releasing said end expansion panel to said expanded position;

said pair of side walls each including a panel of a substantially rigid material for retaining a freestanding shape of the transferrable insert;

at least one handle member for lifting the transferrable insert out of the interior of the bag; and a plurality of pouches within said interior storage compartment for holding and positioning a plurality of objects therein in an organized arrangement.

* * * * *